US007689144B2

(12) United States Patent
Martin et al.

(10) Patent No.: US 7,689,144 B2
(45) Date of Patent: Mar. 30, 2010

(54) SYSTEMS AND METHODS FOR REMANUFACTURING IMAGING COMPONENTS

(75) Inventors: Thomas J. Martin, Sanford, NC (US); James H. Jones, Fayetteville, NC (US); Andrew D. Scott, Raleigh, NC (US); Lawrence Dale Lewis, Sanford, NC (US); Donald R. Huck, Raleigh, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

(21) Appl. No.: 12/190,796

(22) Filed: Aug. 13, 2008

(65) Prior Publication Data

US 2008/0304858 A1 Dec. 11, 2008

Related U.S. Application Data

(63) Continuation of application No. 11/479,798, filed on Jun. 30, 2006.

(51) Int. Cl.
*G03G 15/00* (2006.01)

(52) U.S. Cl. ..... 399/109; 399/111

(58) Field of Classification Search ..... 399/107, 399/109, 110, 111, 119; 222/DIG. 1
See application file for complete search history.

(56) References Cited

U.S. PATENT DOCUMENTS

| | | | |
|---|---|---|---|
| 5,261,326 | A | 11/1993 | Michlin |
| 5,476,818 | A | 12/1995 | Yanof |
| 5,729,795 | A | 3/1998 | Kavolius |
| 5,870,654 | A | 2/1999 | Sato |
| 6,097,908 | A | 8/2000 | Uchiyama et al. |
| 6,166,916 | A | 12/2000 | Jelinger |
| 6,219,506 | B1 | 4/2001 | Morinaga |
| 6,615,008 | B2 | 9/2003 | Higeta |
| 6,654,577 | B1 | 11/2003 | Hooper |
| 6,701,107 | B2 | 3/2004 | Karakama et al. |
| 6,721,520 | B2 | 4/2004 | Higeta |
| 6,788,908 | B2 | 9/2004 | Sekine |
| 6,801,734 | B1 | 10/2004 | Jones |
| 6,904,248 | B2 | 6/2005 | Daniels |
| 6,941,092 | B2 | 9/2005 | Yokoi |
| 7,054,577 | B2 | 5/2006 | Rogers |
| 7,068,963 | B2 | 6/2006 | Moore |
| 2005/0036801 | A1 | 2/2005 | Burchette |

FOREIGN PATENT DOCUMENTS

| | | |
|---|---|---|
| EP | 0939357 | 9/1999 |
| GB | 2389196 | 12/2003 |

*Primary Examiner*—Hoan H Tran

(57) ABSTRACT

Techniques for attaching a replacement chip to an imaging cartridge are described. a method of replacing a component of an imaging cartridge includes: providing the imaging cartridge including a chip and a chip holding structure holding the chip, the chip holding structure including a left upper flange, a right upper flange, a rear retaining member, bottom supporting rails, a left forward retaining element extending from the left upper flange, and a right forward retaining element extending from the right upper flange; removing at least a portion of the left forward retaining element and the right forward retaining element to form a modified chip holding structure; removing the chip from the cartridge; installing a replacement chip in the modified chip holding structure; and attaching the replacement chip to the imaging cartridge.

10 Claims, 14 Drawing Sheets

SYSTEMS AND METHODS FOR REMANUFACTURING IMAGING COMPONENTS

The present application is a continuation of U.S. patent application Ser. No. 11/479,798 filed Jun. 30, 2006, which is herein incorporated by reference in its entirety.

BACKGROUND

The present invention generally relates to manufacturing, remanufacturing or repairing replaceable imaging components, and more particularly to apparatus and techniques for replacing an electronic circuit.

In the imaging industry, there is a growing market for the remanufacture and refurbishing of various types of replaceable imaging cartridges such as toner cartridges, drum cartridges, inkjet cartridges, and the like. These imaging cartridges are used in imaging devices such as laser printers, xerographic copiers, inkjet printers, facsimile machines and the like, for example. Imaging cartridges, once spent, are unusable for their originally intended purpose. Without a refurbishing process these cartridges would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the imaging cartridge.

Some toner cartridges may include a chip having a memory device which is used to store data related to the cartridge or the imaging device, such as a printer, for example. The imaging device may communicate with the chip using a direct contact method or a broadcast technique utilizing radio frequency (RF) communication. This chip is typically mounted in a location, such as a slot on the cartridge to allow for proper communication between the printer and the toner cartridge when the cartridge is installed in the printer. When the toner cartridge is being remanufactured, as described above, the chip provided by the original equipment manufacturer (OEM), such as Hewlett-Packard or Lexmark, may need to be replaced by a compatible chip developed by a third party. Due to the design of the toner cartridge, a certain part of the cartridge which helps hold the chip in place may need to be permanently removed in order to remove the OEM chip. With the part of the toner cartridge removed, a replacement chip would not be secured to the cartridge when it is installed. Thus, it would be desirable to provide techniques for attaching a replacement chip to such a toner cartridge.

SUMMARY

In one aspect of the present invention a method of replacing a component of an imaging cartridge includes: providing the imaging cartridge comprising a chip and a chip holding structure holding the chip, the chip holding structure including a left upper flange, a right upper flange, a rear retaining member, bottom supporting rails, a left forward retaining element extending from the left upper flange, and a right forward retaining element extending from the right upper flange; removing at least a portion of the left forward retaining element and the right forward retaining element to form a modified chip holding structure; removing the chip from the cartridge; installing a replacement chip in the modified chip holding structure; and attaching the replacement chip to the imaging cartridge.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings which illustrate specific embodiments of the invention. In the discussion that follows, specific systems and techniques for repairing, manufacturing or remanufacturing a toner cartridge are disclosed. Other embodiments having different structures and operations for the repair, remanufacture and operation of other types of replaceable imaging components and for various types of imaging devices, such as laser printers, inkjet printers, copiers, facsimile machines and the like, do not depart from the scope of the present invention.

Figure 1:
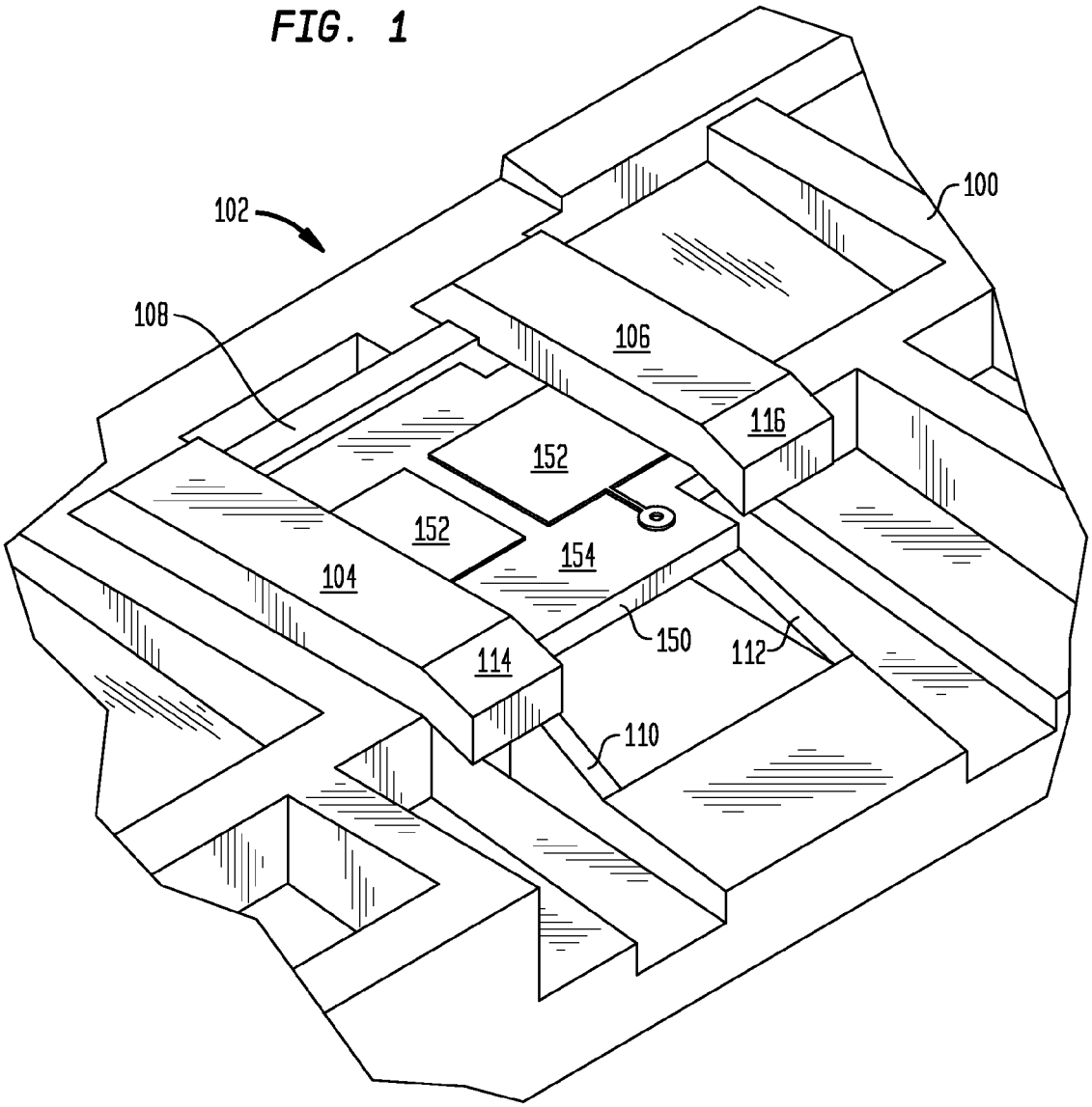
FIG. 1 shows a perspective view of a chip holding area of a toner cartridge.
Figure 1A:
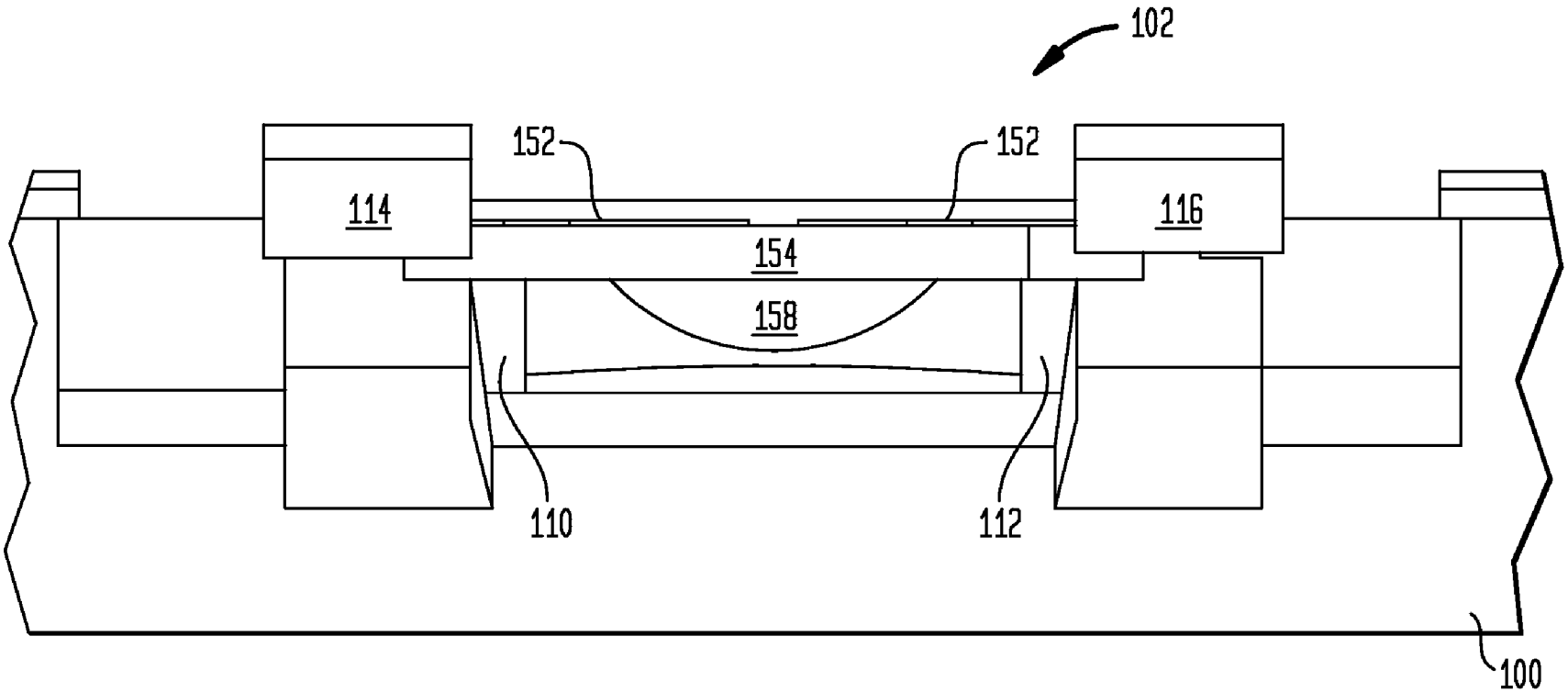
FIG. 1A shows a frontal view of the chip holding area of the toner cartridge.

FIGS. 1 and 1A show, respectively, a perspective view and a frontal view of a portion of a prior art toner cartridge 100. As understood by one of ordinary skill in the art, the toner cartridge 100 may include, among other components, a waste bin, a toner hopper, and an organic photo conductor (OPC) drum. The toner cartridge 100 also includes a chip holding structure 102 comprising a left upper flange 104, a right upper flange 106, a rear retaining member 108, bottom supporting rails 110 and 112, a left forward retaining element 114 extending from the left upper flange 104, and a right forward retaining element 116 extending from the right upper flange 106 of the toner cartridge 100. The chip holding structure 102 holds a chip 150 in a substantially fixed position. The chip 150 may include electrical contacts 152 on one side of a printed circuit board (PCB) 154 for engagement with a printer and circuitry 158 including a memory element on the opposing side.

The left upper flange 104 and the right upper flange 106 hold the chip 150 from the top and the sides while the bottom supporting rails 110 and 112 support the bottom of the chip 150. The rear retaining member 108 holds the chip 150 from the rear, and the left forward retaining element 114 and the right forward retaining element 116 hold the chip 150 from the front. As seen in FIG. 1, the left forward retaining element 114 and the right forward retaining element 116 are angled diagonally across a front edge of the chip 150.

Figure 2:
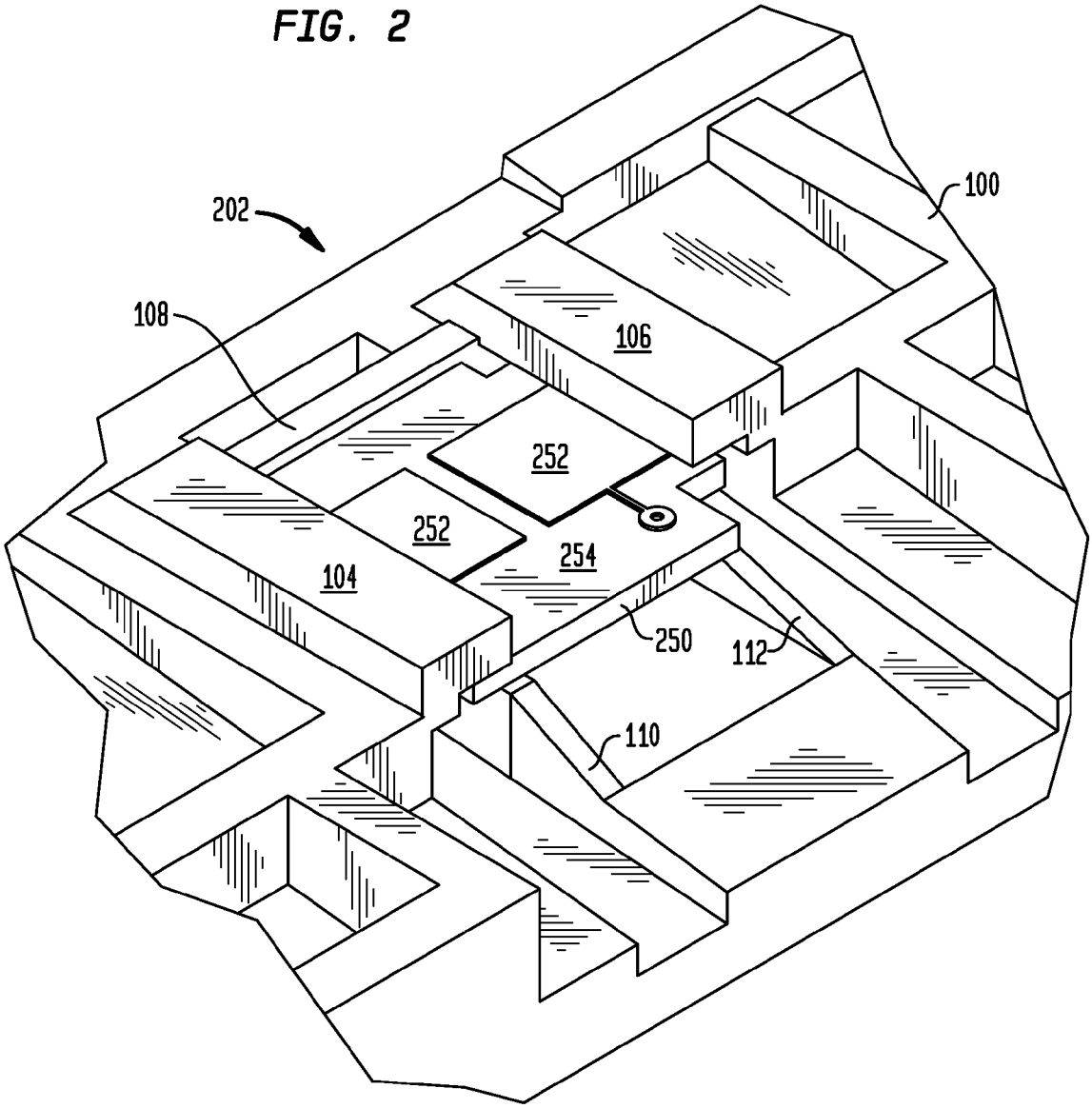
FIG. 2 shows a perspective view of a modified chip holding area of a toner cartridge with the forward retaining elements removed and with a replacement chip installed in accordance with the present invention.
Figure 3:
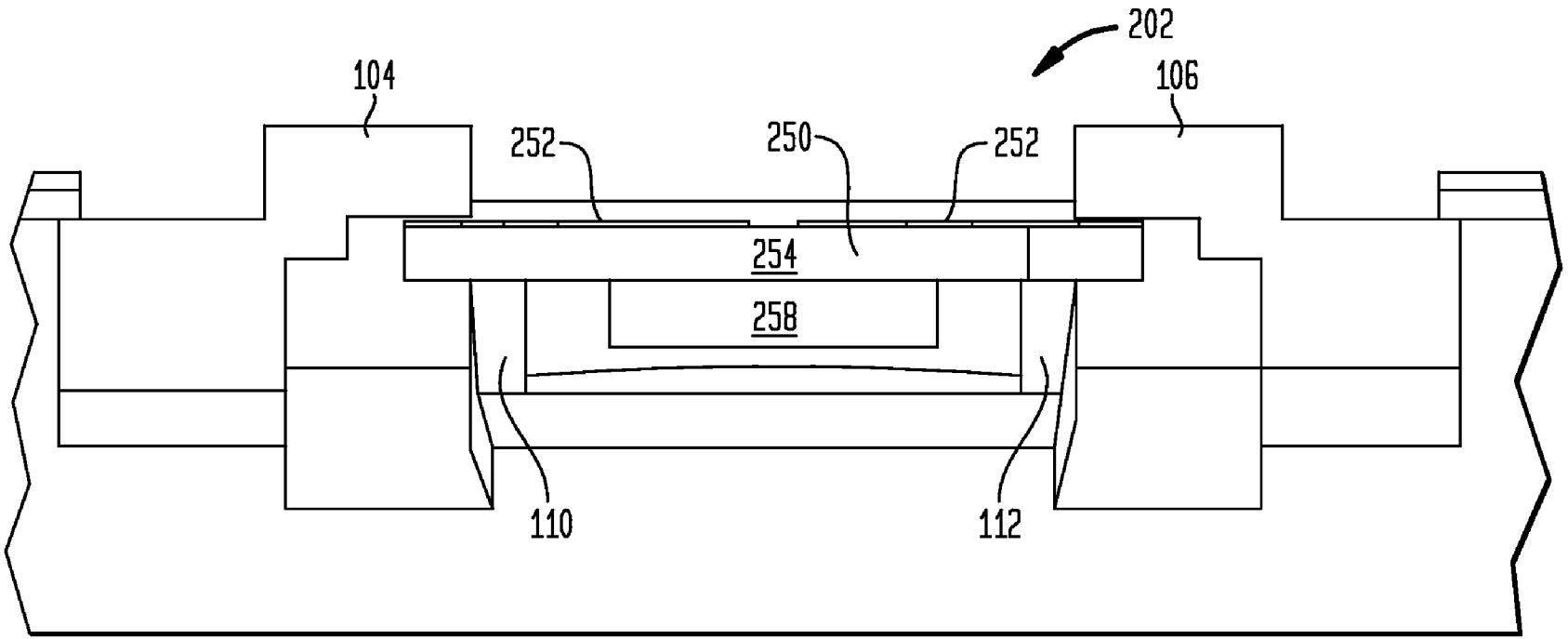
FIG. 3 shows a frontal view of the modified chip holding area and replacement chip of FIG. 2 in accordance with the present invention.

As described above, during the process of remanufacturing the toner cartridge 100, the chip 150 needs to be removed and replaced with a replacement chip. In order to remove the chip 150, the forward retaining element 114 and the forward retaining element 116 should be removed. This removal may be accomplished through the use of a cutting tool, such as knife, for example. As the chip 150 is not secured directly to the toner cartridge 100, the chip 150 may then be removed. A replacement chip may then be inserted into the area previously occupied by the chip 150. FIGS. 2 and 3 show, respectively, a perspective view and a frontal view of a modified chip holding structure 202 of a toner cartridge 100 with the forward retaining elements 114 and 116 removed and with a replacement chip 250 installed in accordance with the present invention. The replacement chip 250 may comprise contacts 252 on one side of a PCB 254 communicatively connected to a circuitry unit 258, such as a microcontroller, memory device or application specific integrated circuit (ASIC), for example. With the forward retaining elements 114 and 116 removed, the replacement chip 250 is not be secured to the toner cartridge 100. The present invention provides techniques for solving this problem and attaching a replacement chip 250 to the modified chip holding structure 202 of the toner cartridge 100.

Figure 4:
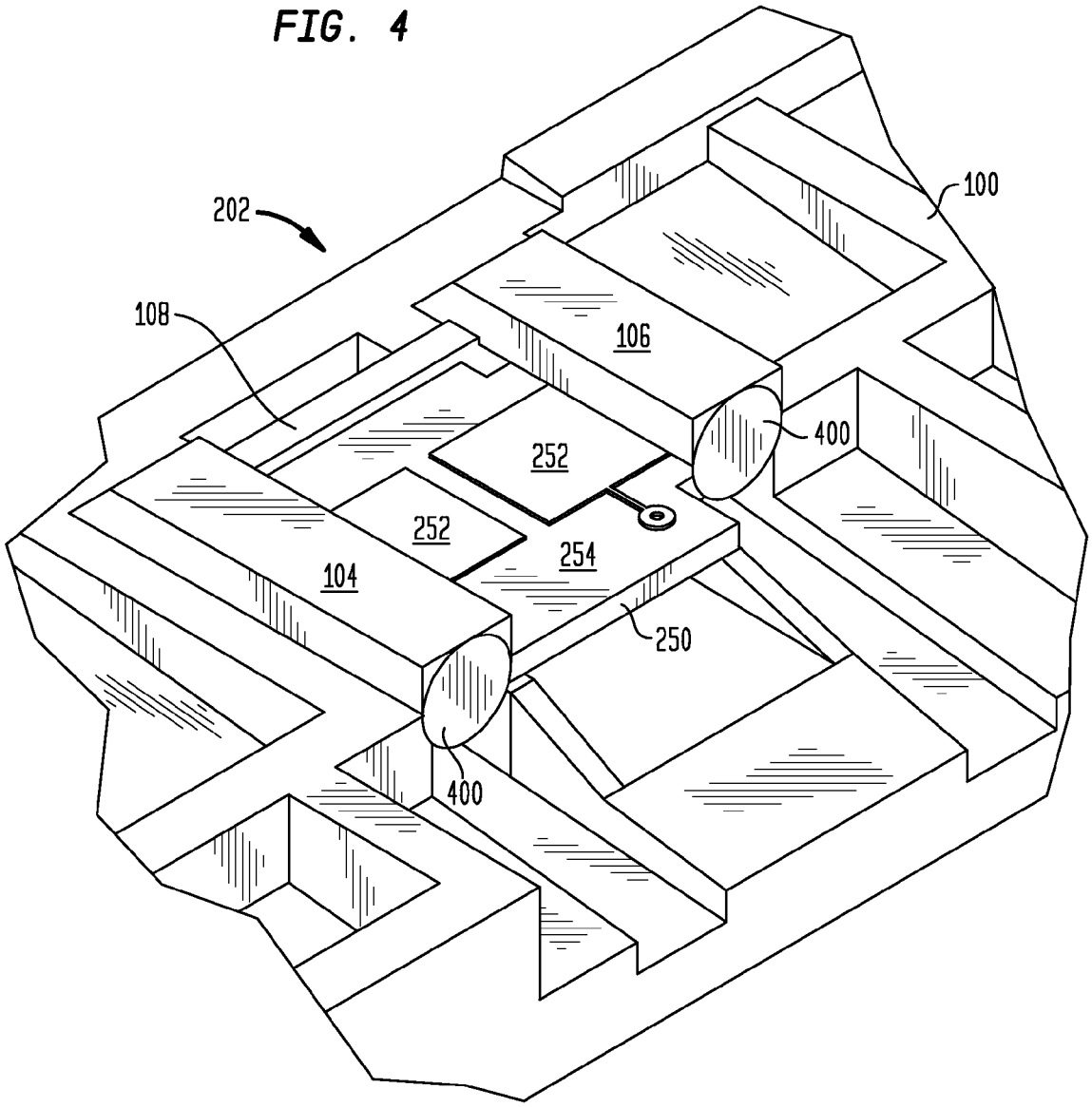
FIG. 4 shows a perspective view of the modified chip holding area, replacement chip and glue drops in accordance with the present invention.

FIG. 4 shows a perspective view of the modified chip holding structure 202, replacement chip 250 and adhesive drops 400 in accordance with the present invention. In one aspect of the present invention, after the replacement chip 250 has been installed in the modified chip holding structure, one or more adhesive drops 400 may be placed on the toner cartridge 100 and the replacement chip 250 to secure the replacement chip 250 in place. The adhesive drops 400 may suitably comprise glue or other adhesive material. In a preferred embodiment, the adhesive drops are placed along an edge of the PCB 254, as shown in FIG. 4, in the area where the left forward retaining element 114 and the right forward retaining element were removed.

Figure 5:
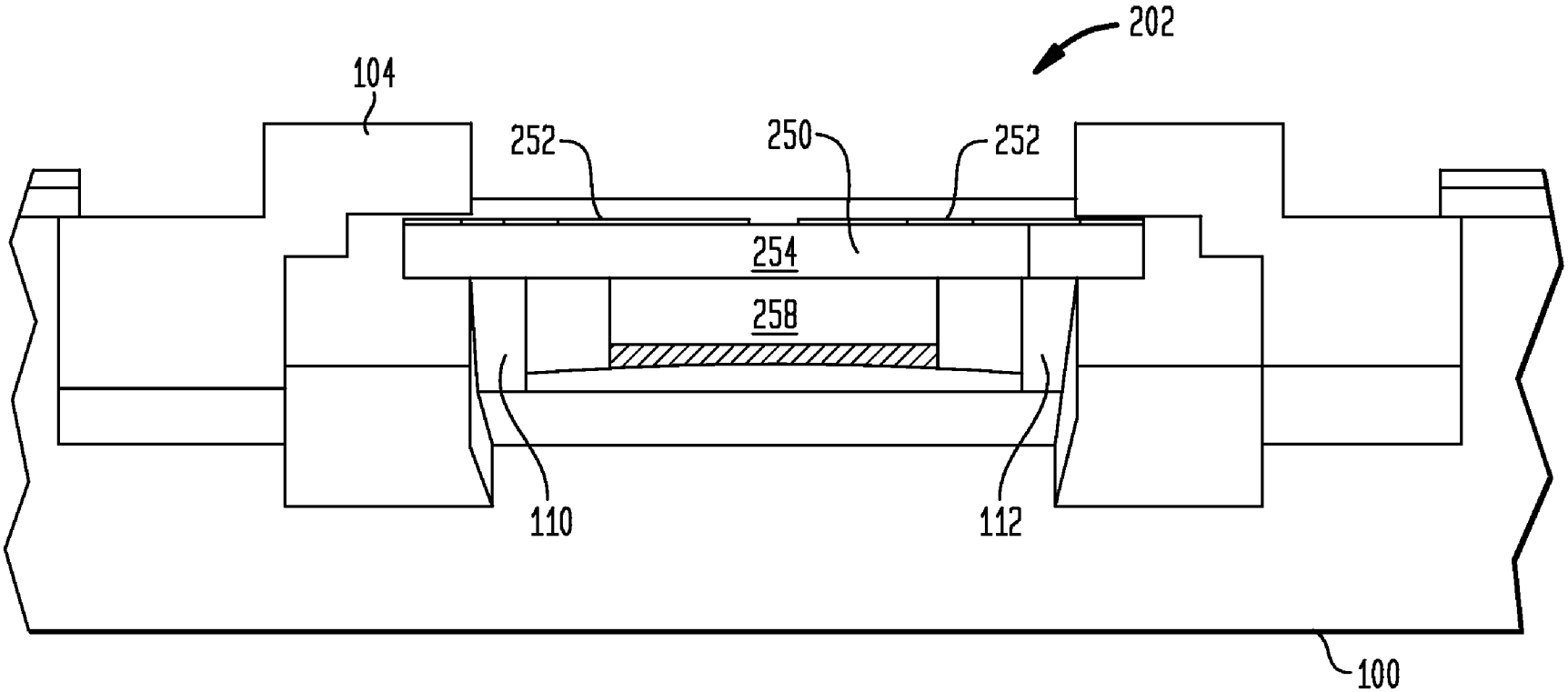
FIG. 5 shows a frontal view of the modified chip holding area, replacement chip and adhesive layer in accordance with the present invention.

FIG. 5 shows a frontal view of the modified chip holding structure 202, replacement chip 250 and adhesive layer 500 in accordance with another aspect of the present invention. The adhesive layer 500 may comprise a double-sided adhesive, manufactured glue dot, or the like which is attached to the underside of the replacement chip 250 prior to installation of the replacement chip 250. Alternatively, the adhesive layer 500 may be attached to the modified chip holding structure 202 prior to installation of the replacement chip 250. After the replacement chip 250 is installed in the modified chip holding structure 202, the adhesive layer 500 attaches the replacement chip 250 to the toner cartridge 100. When the replacement chip 250 is installed, a small amount of space should be maintained between the adhesive layer 500 and the toner cartridge (or, alternatively, between the adhesive layer 500 and the replacement chip 250) to ensure there is no binding before the replacement chip 250 is fully inserted. Alternatively, the adhesive layer 500, which may comprise a glue dot or glue, may be inserted between the replacement chip 250 and the toner cartridge after the replacement chip 250 has been installed.

Figure 6:
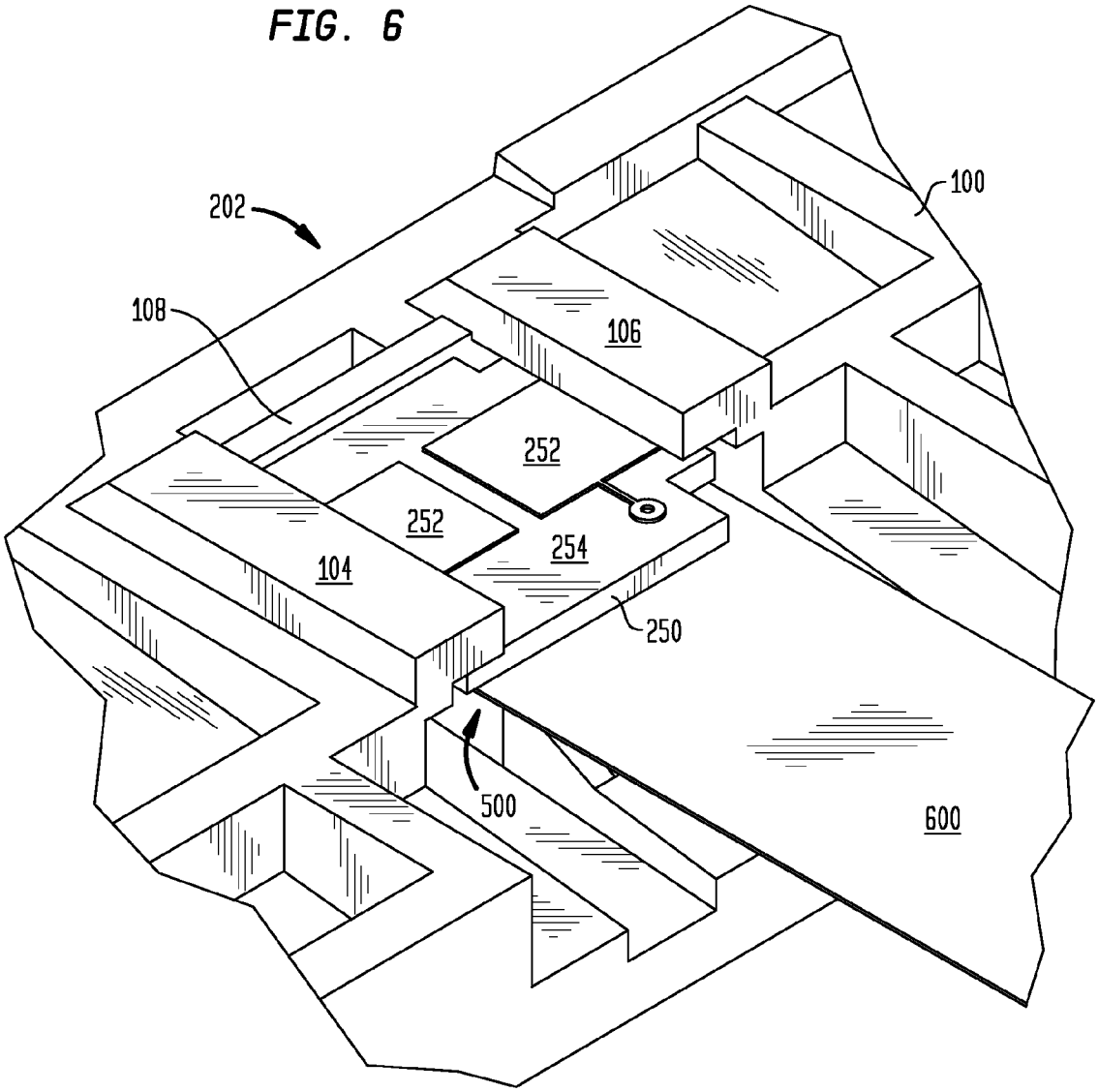
FIG. 6 shows a perspective view of modified chip holding area, replacement chip and adhesive with release liner in accordance with the present invention.

Alternatively, as shown in FIG. 6, a pull film or release liner 600 may be attached to the adhesive layer 500. FIG. 6 shows a perspective view of the modified chip holding structure 202, replacement chip 250 and adhesive with release liner 600 in accordance with the present invention. The release liner 600 is attached to and covers the adhesive layer 500, and extends outward from the replacement chip 250. When the replacement chip 250 is inserted into the modified chip holding structure 202, the release liner 600 protects the adhesive, acting as a mechanical buffer between the adhesive layer 500 and the toner cartridge 100. After installation, the release liner 600 is pulled away, exposing the adhesive layer 500 to the toner cartridge 100. Light pressure on the front face of the replacement chip 250 may be needed to fully activate the adhesive bond between the replacement chip 250 and the toner cartridge 100.

Figure 7:
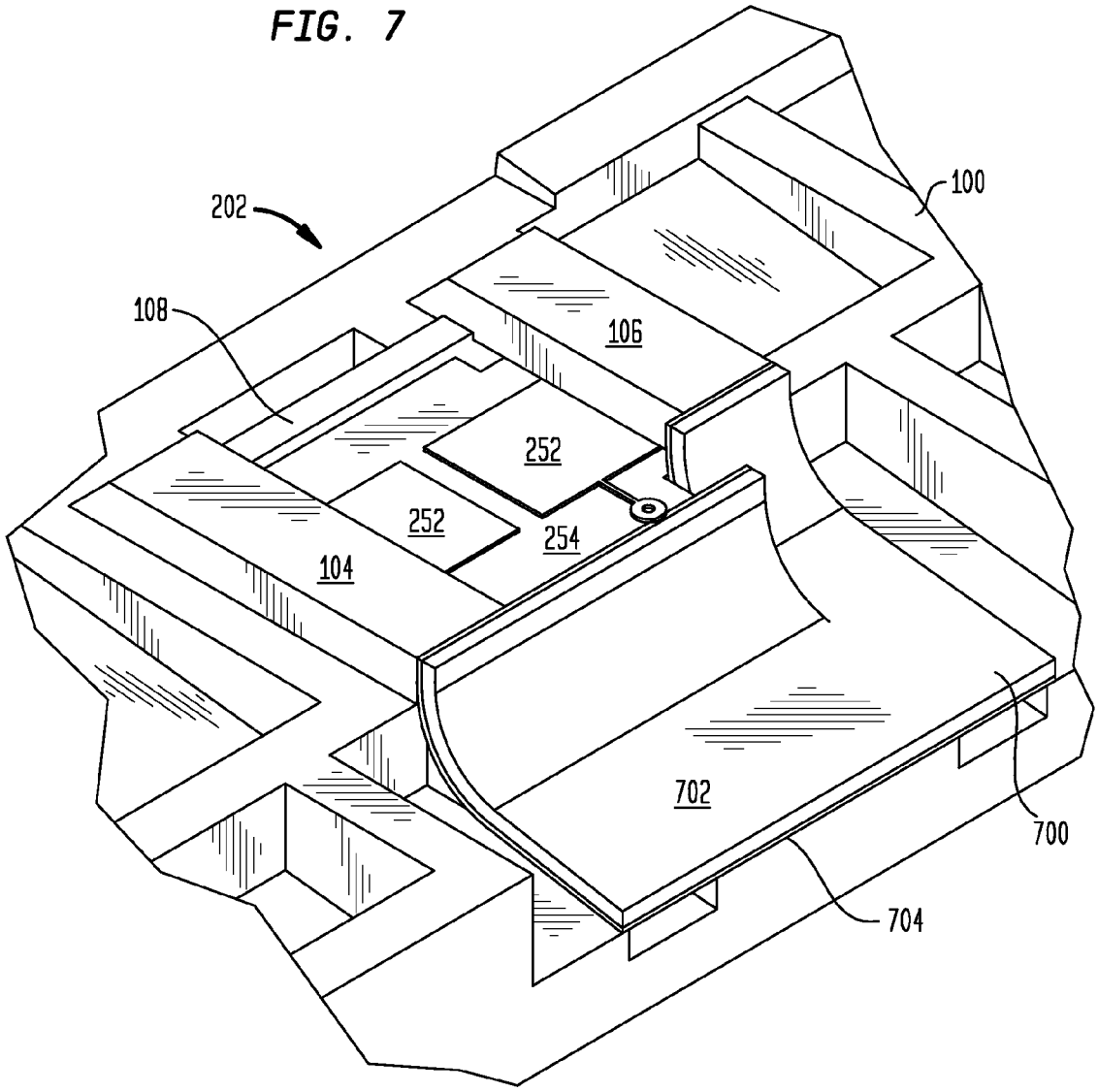
FIG. 7 shows a perspective view of modified chip holding area, replacement chip and blocking element in accordance with the present invention.

FIG. 7 shows a perspective view of the modified chip holding structure 202, replacement chip 250 and blocking element 700 in accordance with another aspect of the present invention. The blocking element 700 attaches to the toner cartridge 100 and secures the replacement chip 250 in place in the modified chip holding structure 202. The blocking element 700 may suitably comprise a material 702, such as high impact polystyrene (HIPS), with an adhesive layer 704 securing the blocking element 700 in place. Alternatively, the blocking element 700 may comprise other securing techniques, such as a clip or a fastener, for example.

Figure 8:
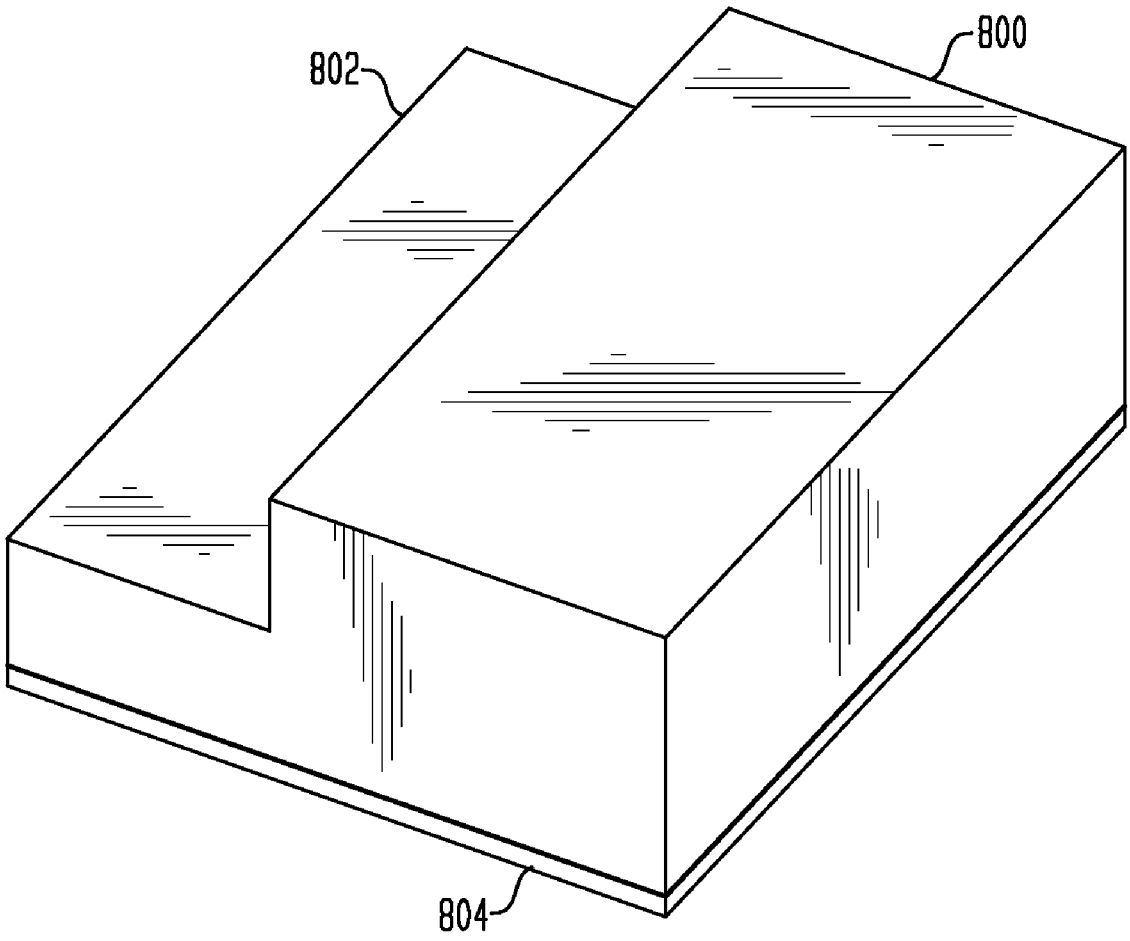
FIG. 8 shows a perspective view of a plug insert in accordance with the present invention.
Figure 9:
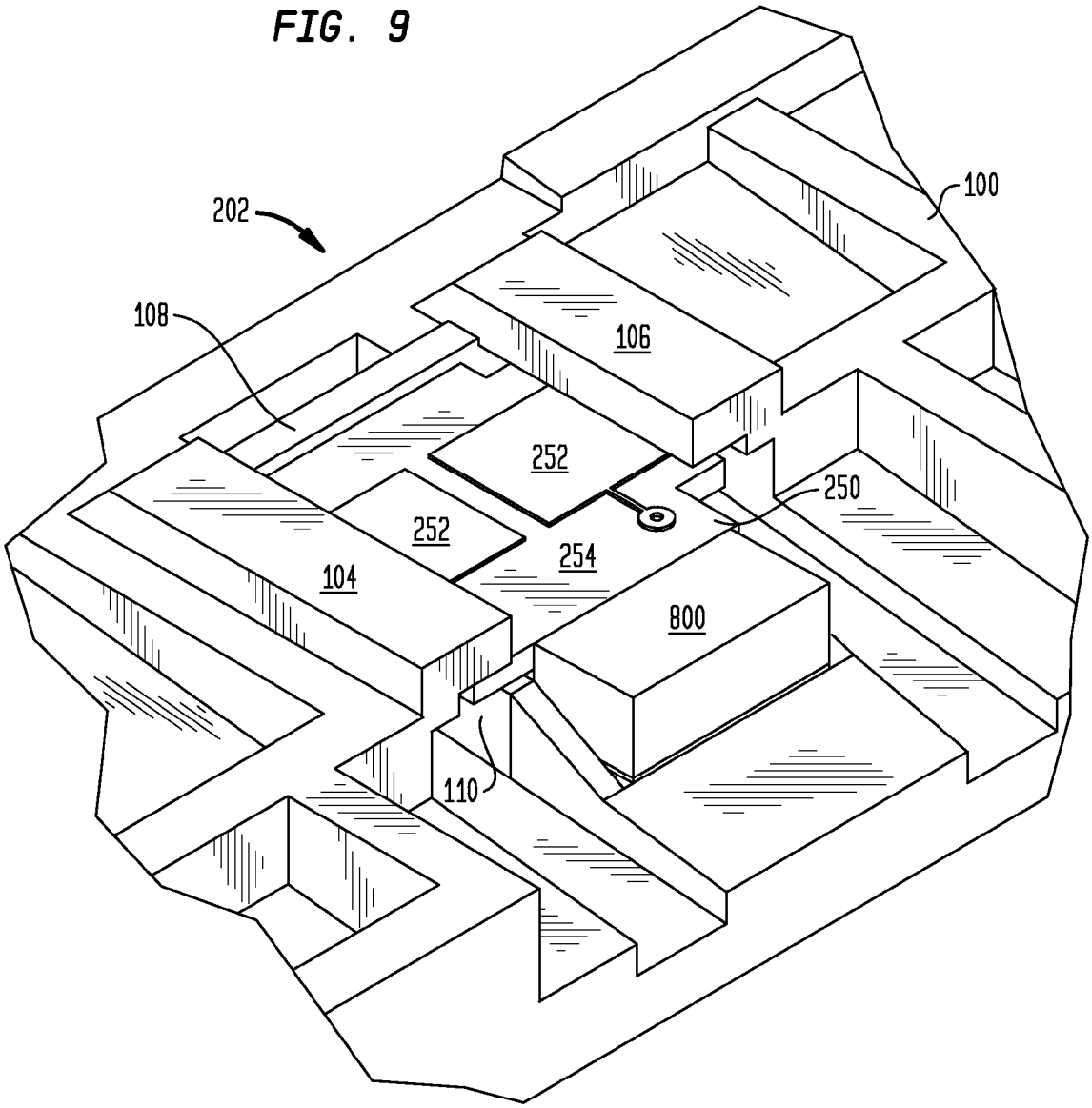
FIG. 9 shows a perspective view of the modified chip holding area, replacement chip and a plug insert installed in accordance with the present invention.

In another aspect of the present invention, a plug insert 800 may hold the replacement chip 250 in place. FIG. 8 shows the plug insert 800 in accordance with the present invention. The plug insert 800 is inserted into the front of the modified chip holding structure 202 after the replacement chip 250 is installed and locks into place, as shown in FIG. 9. A variety of techniques may be used to lock the plug insert 800 into place including, for example, glue, snap mechanisms, or press fit features such as crush ribs. The plug insert 800 may include a narrowed section 802 which slides under the replacement chip 250. In an alternate embodiment the plug insert 800 may include an adhesive layer 804 holding the plug insert 800 in place. The plug insert 800 may suitably comprise molded plastic.

Figure 10:
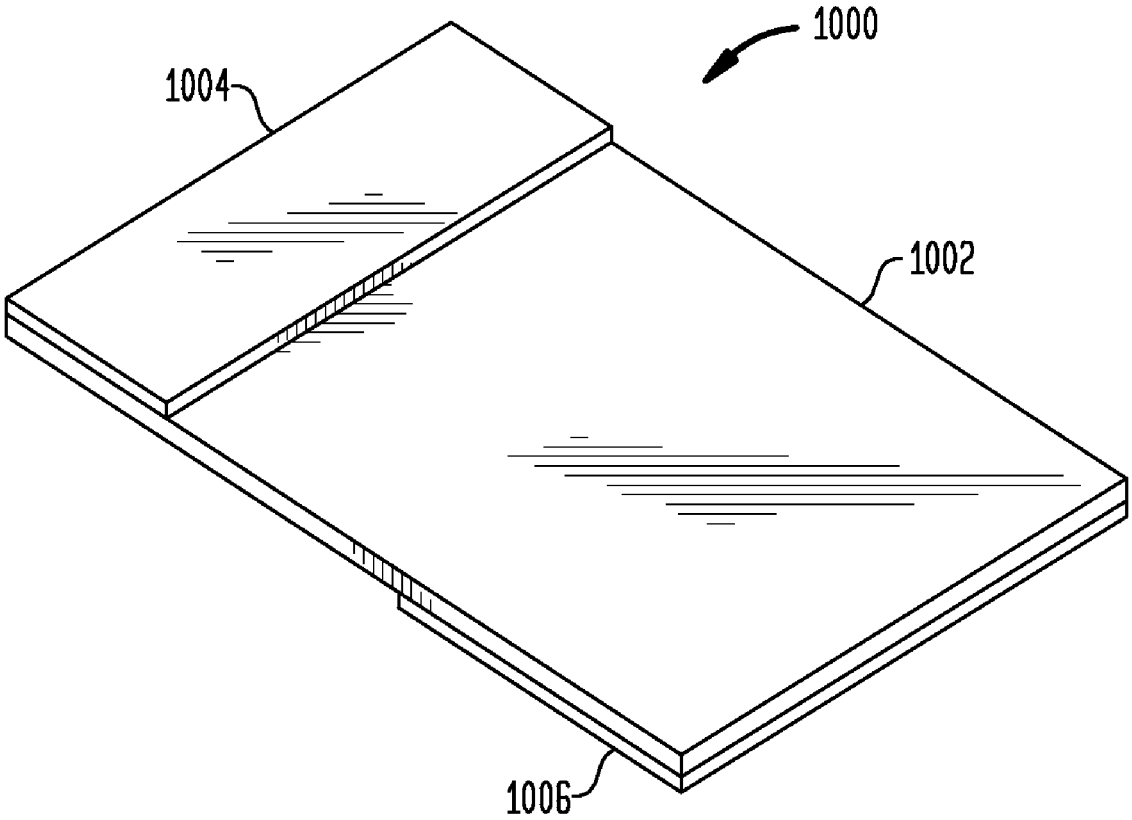
FIG. 10 shows a perspective view of a locking flange in accordance with the present invention.
Figure 11:
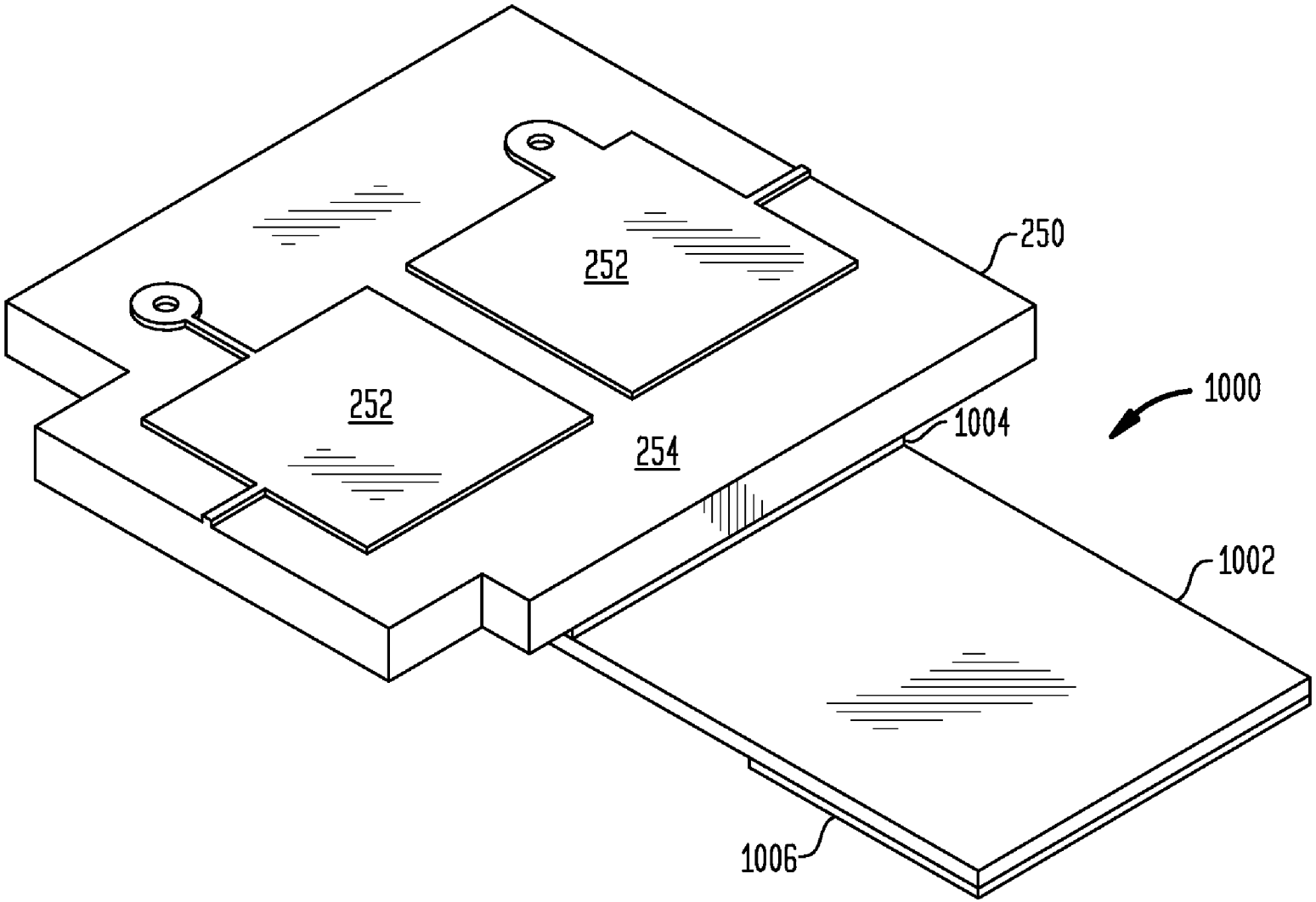
FIG. 11 shows a perspective view of a locking flange attached to a replacement chip in accordance with the present invention.
Figure 11A:
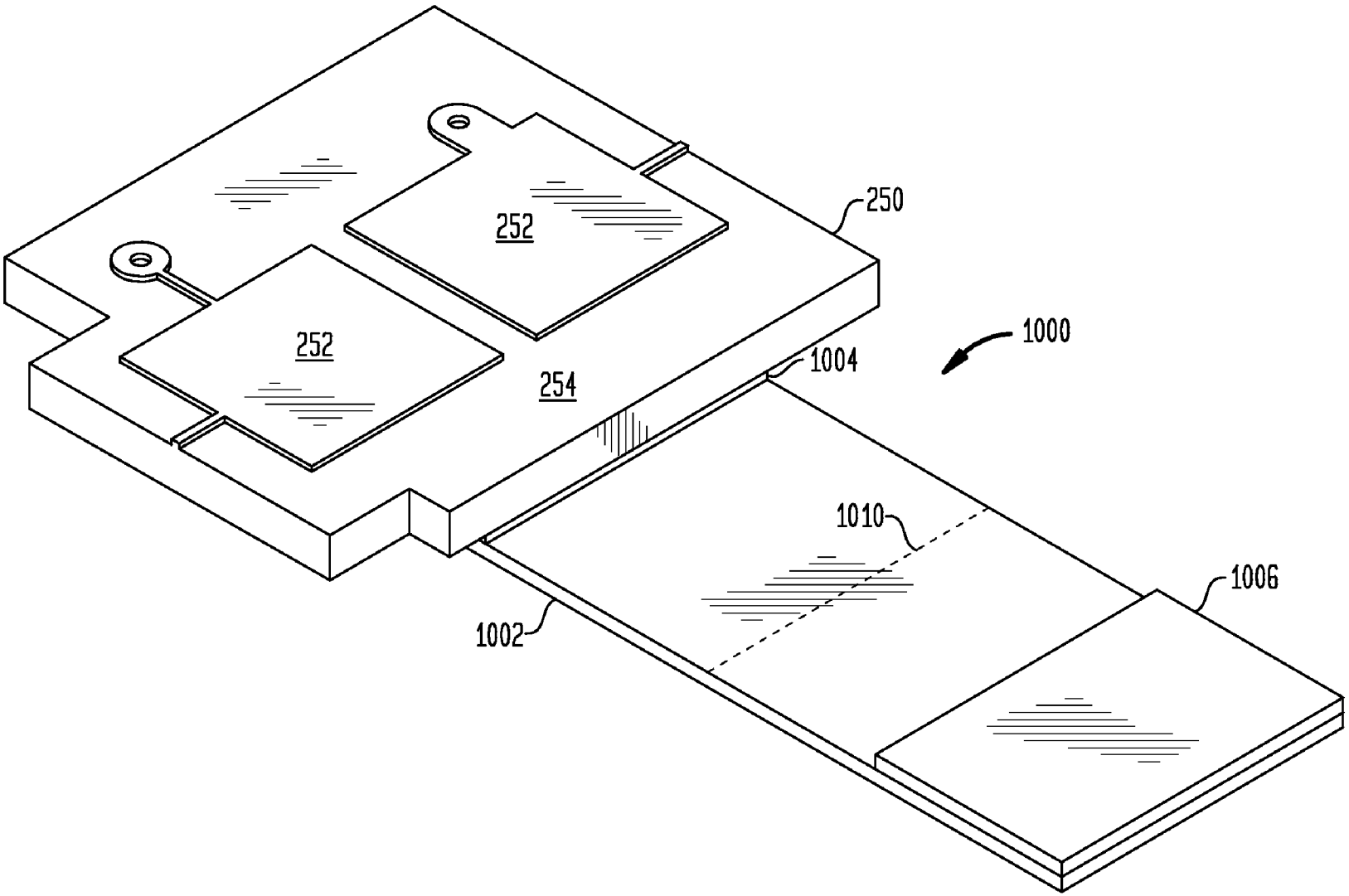
FIG. 11A shows a perspective view of an alternate embodiment of a locking flange attached to a replacement chip in accordance with the present invention.
Figure 12:
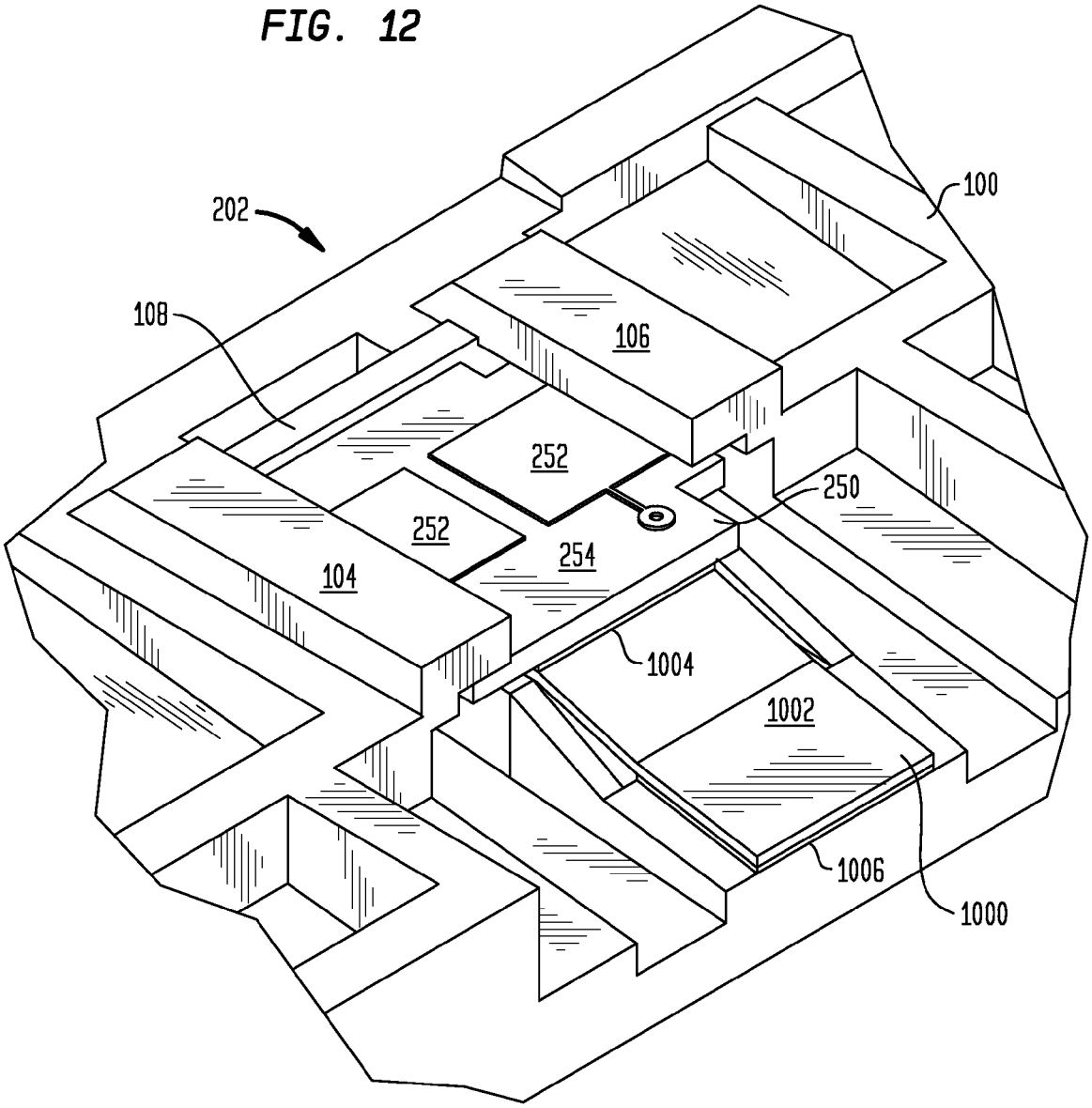
FIG. 12 shows a perspective view of the modified chip holding area, replacement chip and locking flange in accordance with the present invention.

In another aspect of the present invention, a locking flange 1000 may hold the replacement chip 250 in place. FIG. 10 shows the locking flange 1000 in accordance with the present invention. The locking flange 1000 may comprise a base 1002, a chip adhesive layer 1004 on one side of the base 1002 and a locking adhesive layer 1006 on the opposing side of the base 1002. The base 1002 may suitably comprise HIPS, plastic film, and the like, for example. As shown in FIG. 11, the chip adhesive layer 1004 attaches the locking flange 1000 to the underside of the replacement chip 250. After the replacement chip 250 is installed in the modified chip holding structure 202, the end of the locking flange 1000 extending outward from the replacement chip 250 is folded down and attached to the toner cartridge 100 by the adhesive layer 1006. See FIG. 12. To remove the replacement chip 250 during future remanufacturing, the end of the locking flange 1000 is lifted off the toner cartridge 100 and pulled, thereby removing the replacement chip 250. In an alternate embodiment, the locking adhesive layer 1006 may be located on the same side of the base 1002 as the chip adhesive layer 1004, as shown in FIG. 11A, with the end of the locking flange 1000 extending outward from the replacement chip 250 being folded along line 1010, for example, to orient the locking adhesive layer for attachment to the toner cartridge 100.

Although specific embodiments have been illustrated and described herein, those of ordinary skill in the art appreciate that any arrangement that is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A method of replacing a component of an imaging cartridge comprising:

providing the imaging cartridge comprising a chip and a chip holding structure holding the chip, the chip holding structure comprising a left upper flange, a right upper flange, a rear retaining member, bottom supporting rails, a left forward retaining element extending from the left upper flange, and a right forward retaining element extending from the right upper flange;

removing at least a portion of the left forward retaining element and the right forward retaining element to form a modified chip holding structure;

removing the chip from the cartridge;

installing a replacement chip in the modified chip holding structure; and securing the replacement chip to the imaging cartridge.

2. The method of claim 1 wherein, before removing at least one portion, the left forward retaining element and the right forward retaining element are angled across a front edge of the chip.

3. The method of claim 1 wherein an adhesive attaches the replacement chip to the imaging cartridge.

4. The method of claim 3 wherein, before installing the replacement chip, a first side of the adhesive is attached to a bottom of the chip and a second side of the adhesive is covered by a release liner, and wherein securing the replacement chip to the imaging cartridge comprises removing the release liner after the replacement chip has been installed in the modified chip holding structure and engaging the second side of the adhesive to the imaging cartridge.

5. The method of claim 3 wherein, before installing the replacement chip, a first side of the adhesive is attached to the imaging cartridge and a second side of the adhesive is covered by a release liner, and wherein securing the replacement chip to the imaging cartridge comprises removing the release liner after the replacement chip has been installed in the modified chip holding structure and engaging the second side of the adhesive to a bottom of the chip.

6. The method of claim 3 wherein the adhesive comprises drops of glue placed along a portion of an edge of the replacement chip.

7. The method of claim 1 wherein the step of securing the replacement chip comprises placing a blocking element along an edge of the replacement chip and adhering the blocking element to the imaging cartridge.

8. The method of claim 1 wherein the step of securing the replacement chip comprises securing a plug insert to the imaging cartridge along an edge of the replacement chip.

9. The method of claim 1 wherein the replacement chip comprises a locking flange having a first portion attached to the replacement chip and a second portion extending outward from the replacement chip and attached to the imaging cartridge.

10. The method of claim 9 wherein the first portion is attached to the replacement chip by an adhesive on a first side of the locking flange and the second portion is attached to the imaging cartridge by an adhesive on a second side of the locking flange opposed to the first side.

* * * * *